US006282800B1

(12) United States Patent
Beutler

(10) Patent No.: US 6,282,800 B1
(45) **Date of Patent: *Sep. 4, 2001**

(54) PEEP SIGHT WITH ON/OFF ILLUMINATION BY PROTRUDIING PINS

(75) Inventor: Robert C. Beutler, Sand Creek, MI (US)

(73) Assignee: Kenneth Robertson, Toledo, OH (US); a part interest ( * ) Notice: Subject to any disclaimer, the term of this patent is extended or adjusted under 35 U.S.C. 154(b) by 0 days.

This patent is subject to a terminal disclaimer.

(21) Appl. No.: 09/286,549

(22) Filed: Apr. 5, 1999

Related U.S. Application Data

(60) Provisional application No. 60/080,861, filed on Apr. 6, 1998, and provisional application No. 60/085,040, filed on May 11, 1998.

(51) Int. Cl.[7] ..... F41G 1/00
(52) U.S. Cl. ..... 33/265; 124/87
(58) Field of Search ..... 33/265; 124/87, 124/90

(56) References Cited

U.S. PATENT DOCUMENTS

| | | | | |
|---|---|---|---|---|
| 2,987,821 | | 6/1961 | Kettler . | |
| 3,678,590 | | 7/1972 | Hayward . | |
| 3,703,770 | | 11/1972 | Sofield . | |
| 3,703,771 | | 11/1972 | Saunders . | |
| 3,859,733 | | 1/1975 | Chesnick . | |
| 3,914,873 | | 10/1975 | Elliot, Jr. et al. . | |
| 4,011,853 | | 3/1977 | Fletcher . | |
| 4,177,572 | | 12/1979 | Hindes . | |
| 4,215,484 | | 8/1980 | Lauffenburger . | |
| 4,638,565 | | 1/1987 | Podany et al. . | |
| 4,656,747 | * | 4/1987 | Troncoso | 33/265 |
| 4,689,887 | | 9/1987 | Colvin . | |
| 4,928,394 | | 5/1990 | Sherman . | |
| 4,953,302 | | 9/1990 | Gould . | |
| 4,977,677 | | 12/1990 | Troescher, Jr. . | |
| 5,148,603 | | 9/1992 | Beutler . | |
| 5,157,839 | | 10/1992 | Beutler . | |
| 5,450,673 | * | 9/1995 | Denton | 33/265 |
| 5,669,146 | | 9/1997 | Beutler . | |
| 5,996,569 | * | 12/1999 | Wilson | 33/265 |

FOREIGN PATENT DOCUMENTS

| | | | | |
|---|---|---|---|---|
| 4040642A | * | 10/1991 | (DE) | 33/265 |

* cited by examiner

*Primary Examiner*—Diego Gutierrez
*Assistant Examiner*—Lydia M. DeJesús
(74) *Attorney, Agent, or Firm*—MacMillan, Sobanski & Todd, LLC

(57) ABSTRACT

A rear peep sight to be mounted in a bowstring for aiming an arrow includes a lighting body having front and rear surfaces joined by a side surface, a sighting aperture extending from the rear surface to a cavity open to the front surface and locator apertures formed in the rear surface, an insert retained in the cavity for transmitting ambient light incident at the front surface to the rear surface through the locator apertures, and at least one cover mounted on the rear surface. The cover and the insert are selectively moveable relative to one another to an "on" position in which the incident light is visible to an eye of an archer adjacent the rear surface, an "off" position in which the cover blocks the incident light from the eye and at least one intermediate position in which the cover partially blocks the incident light from the eye. In one embodiment, the cover is rotatably mounted on the rear surface and has opaque "off" sections adjacent to "on" sections. In another embodiment, the cover is fixed on the rear surface and the insert rotates relative to arcuate locator apertures. The rear peep sight also includes slots for mounting in a bowstring and a post for aligning a longitudinal axis of the sighting aperture with a longitudinal axis of an arrow when the sighting body is mounted in bowstring of a bow.

20 Claims, 8 Drawing Sheets

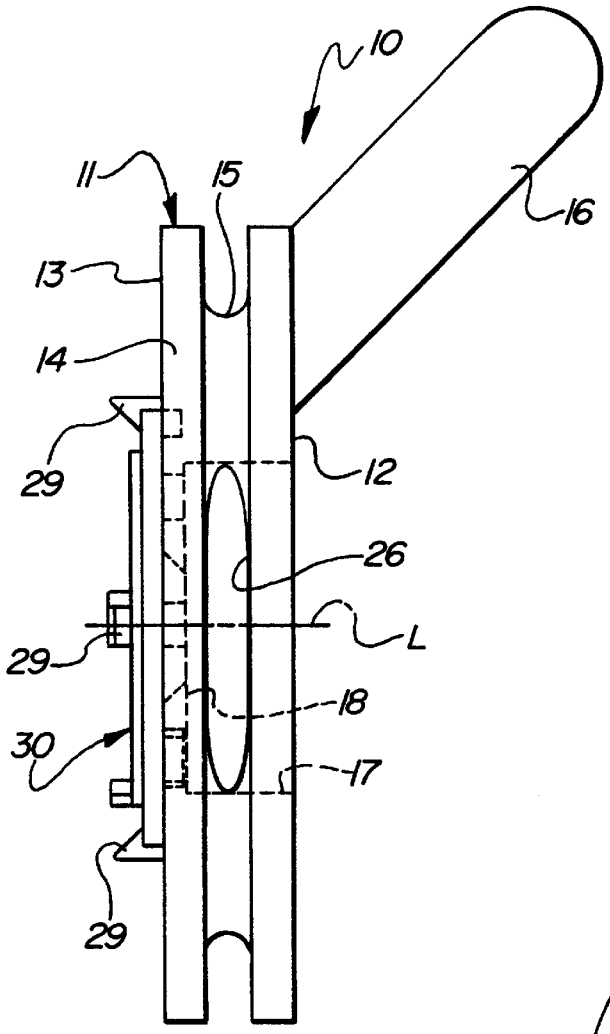
FIG-4
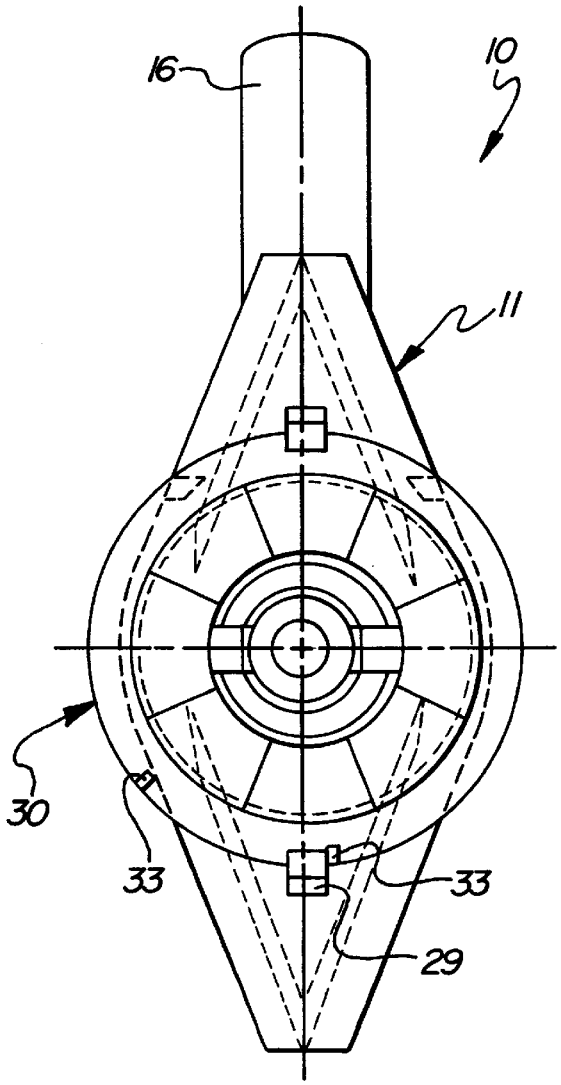
FIG-6
FIG-5
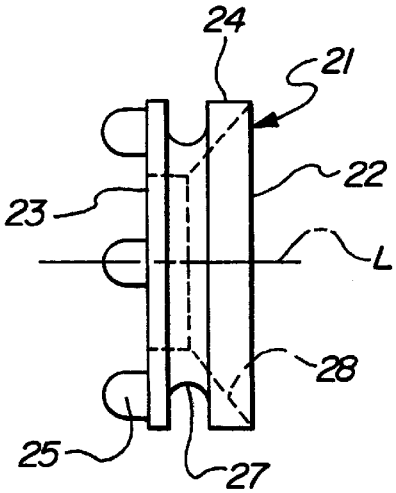

FIG-7
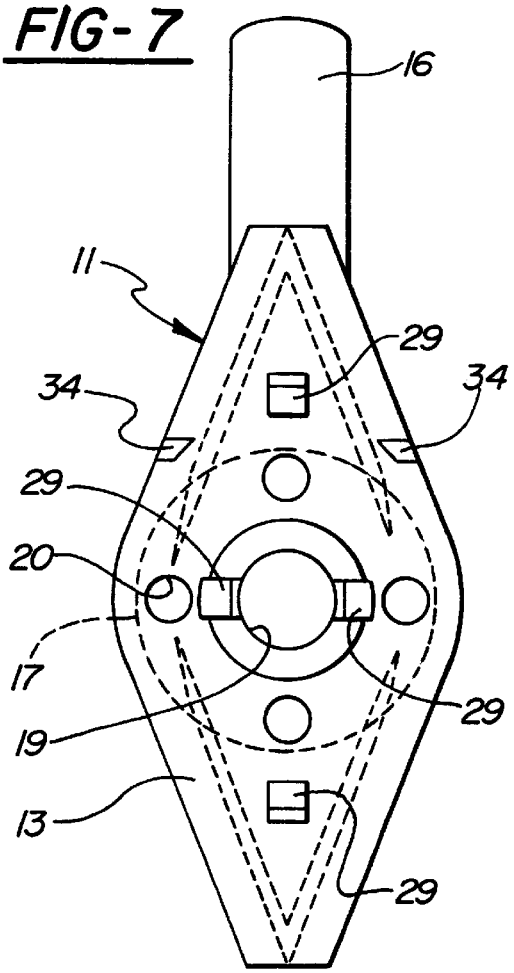
FIG-8
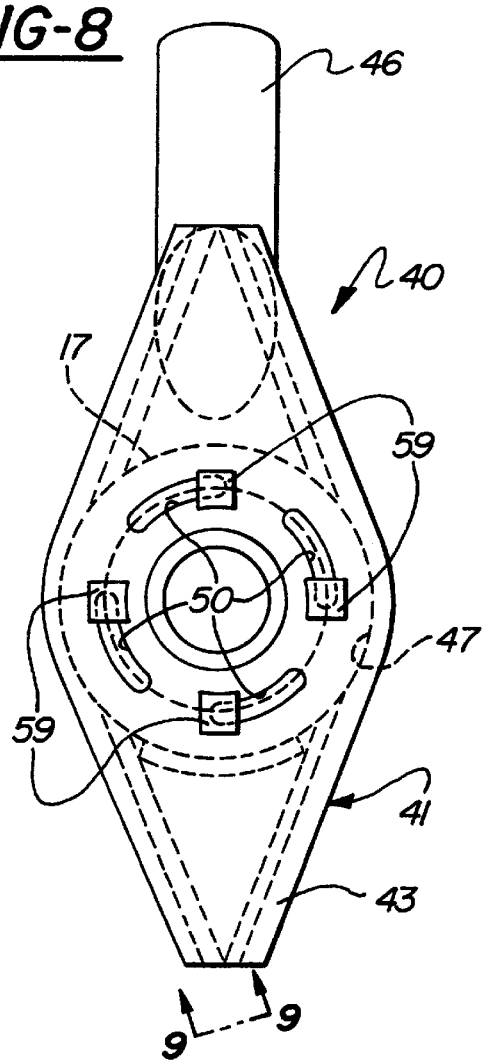
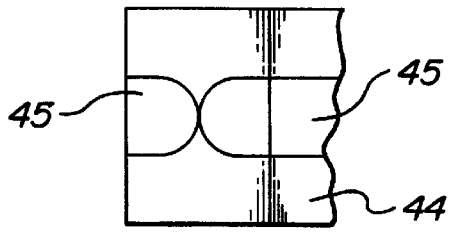
FIG-9
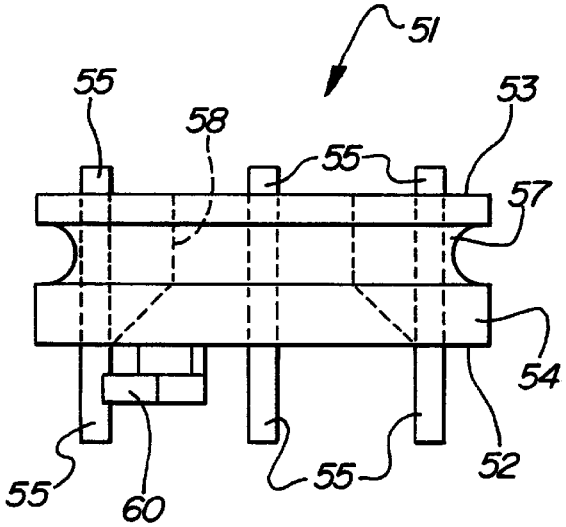
FIG-10

FIG-15
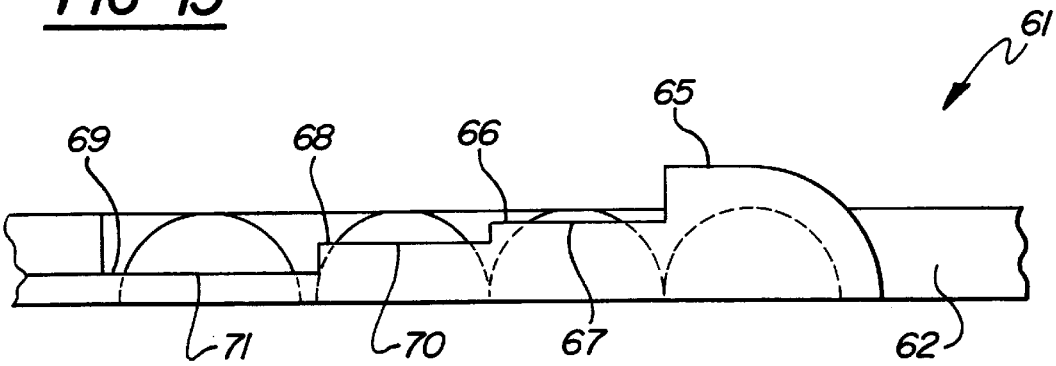
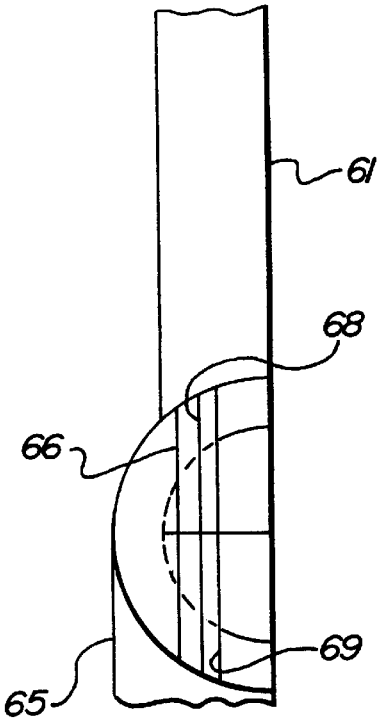
FIG-16
FIG-17
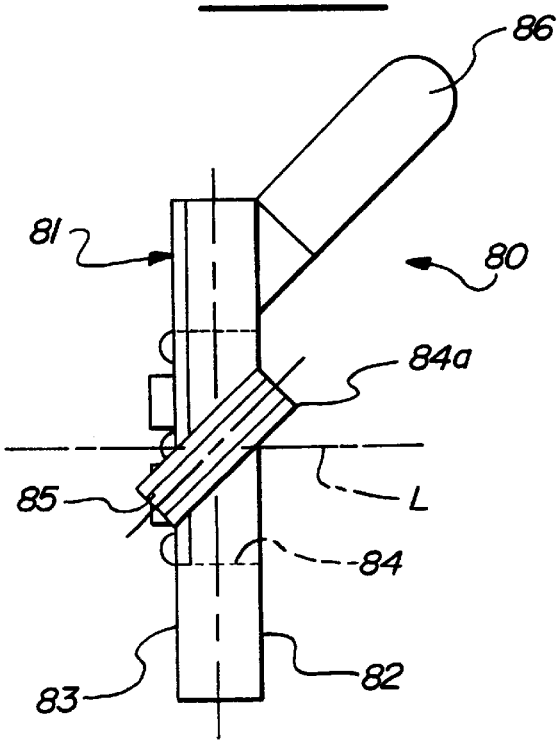

FIG-18
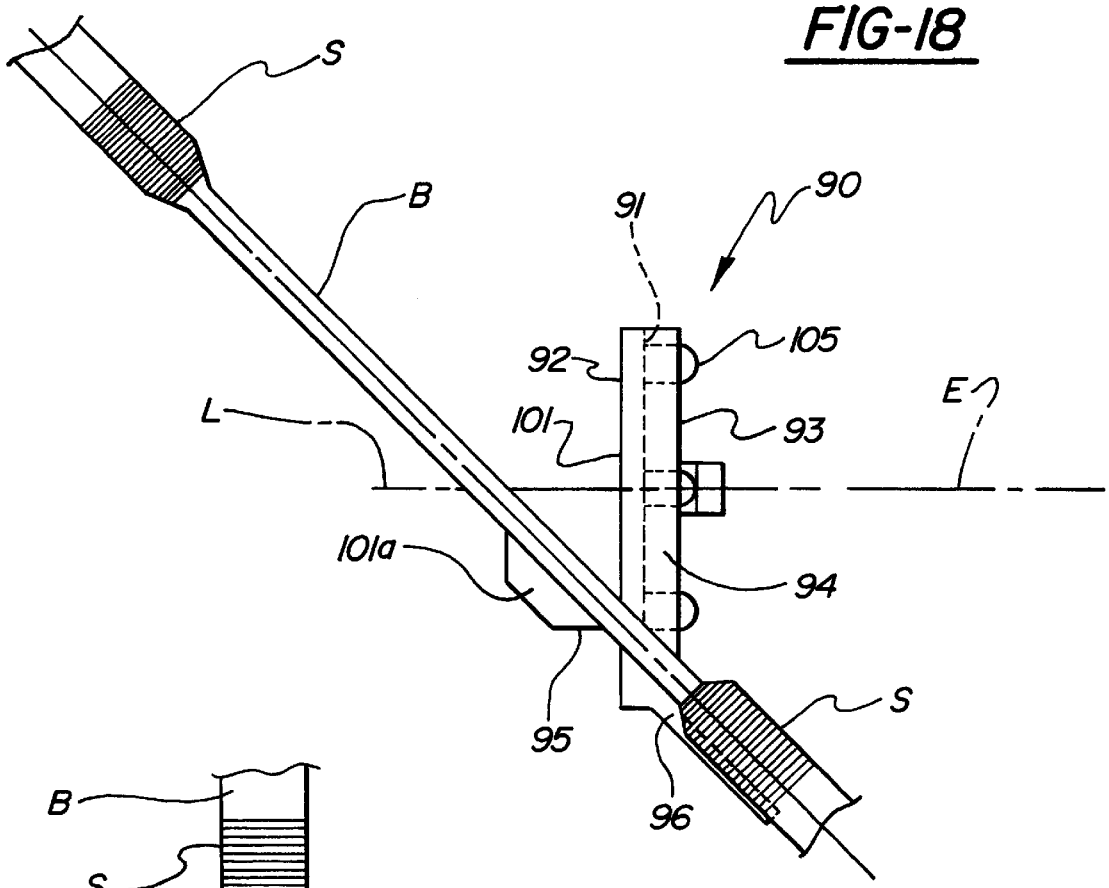
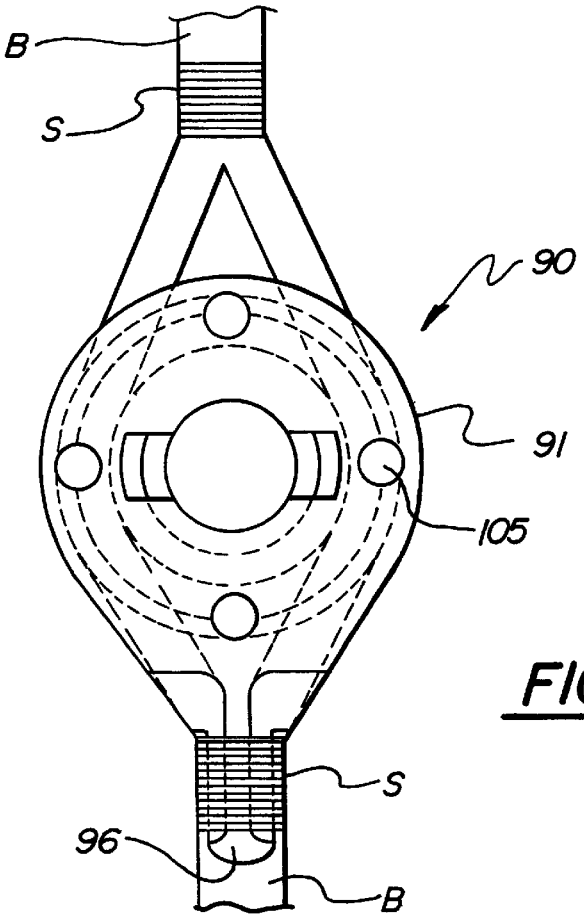
FIG-19

PEEP SIGHT WITH ON/OFF ILLUMINATION BY PROTRUDIING PINS

CROSS-REFERENCE TO RELATED APPLICATIONS

This application claims priority to U.S. Provisional Application Serial No. 60/080,861, filed Apr. 6, 1998, and of U.S. Provisional Application Serial No. 60/085,040, filed May 11, 1998.

BACKGROUND OF THE INVENTION

The present invention relates generally to an apparatus for archery bow sighting and, in particular, to a bowstring mounted, ambient lighted rear peep sight assembly.

An archer, operating a bow, mounts the nock of the arrow at a nocking point on a bowstring of the bow prior to drawing the bowstring back. The arrow's shaft is generally positioned on an arrow rest formed at a midpoint on one side of the bow. The archer then draws the bowstring back using the fingers of one hand while holding the bow with is the opposite hand.

Traditionally, to establish proper arrow trajectory a right handed archer would grip the bowstring with his right hand, draw the string back fully until it touched his right cheekbone, and sight using his right eye down a vertical plane passing along the shaft of the arrow and the left side of the bow.

This method of sighting was prone to error because the sight picture was so large that even the most experienced archer found it difficult to rapidly position the bow and nocked arrow. To improve accuracy and precision of the sighting process, a variety of sighting devices have been developed to provide reference points on the bow and bowstring to make it possible to more easily and more accurately establish a sight picture to aid the archer in establishing proper arrow trajectory.

Such sighting devices include sighting pins for installation on the bow and peep sights for installation in or on the bowstring. Sighting pins are adjustably mounted on and extend horizontally from the bow at a preset position above the arrow rest and are wholly analogous to the open blade sights on most firearms. A peep sight is mounted in spaced relation above the nocking point on the bowstring. Thus, use of sighting pins and peep sights can improve the archer's ability to establish proper arrow alignment and trajectory.

In low light conditions, however, most sights are difficult or impossible to use. One solution, associated with firearms, has been to provide an illuminated sight. The U.S. Pat. No. 2,987,821, the U.S. Pat. No. 3,678,590 and the U.S. Pat. No. 3,914,873 disclose lighted sights for guns. Lighted front sights and sighting pins have been used with bows. For example, the following U.S. Pat. Nos. show lighted front sights for bows: 4,177,572; 4,215,484; 4,638,565; 4,689,887; 4,928,394; 4,953,302 and 4,977,677.

A bow peep sight is also difficult to use in low light conditions. Such peep sights are shown in the U.S. Pat. No. 3,703,770; the U.S. Pat. No. 3,703,771; the U.S. Pat. No. 3,859,733 and the U.S. Pat. No. 4,011,853. Improvements in rear peep sights are shown in my U.S. Pat. No. 5,148,603 and my U.S. Pat. No. 5,157,839.

An illuminated rear peep sight for a projectile device is shown in the U.S. Pat. No. 5,148,603 issued Sep. 22, 1992. An illuminated rear peep sight for a bow is shown in the U.S. Pat. No. 5,157,839 issued on Oct. 27, 1992. A changeable insert peep sight is shown in the U.S. Pat. No. 5,669,146 issued on Sep. 23, 1997.

SUMMARY OF THE INVENTION

The present invention concerns a rear peep sight for use with an archery bow including: a sighting body having front and rear surfaces joined by a side surface and at least one locator aperture formed in the rear surface and extending to a cavity open to the front surface; means for transmitting ambient light incident at the front surface to the rear surface through the locator aperture retained in the cavity; and at least one cover mounted on the rear surface. The cover and the means for transmitting being selectively moveable relative to one another to an "on" position in which the incident light is visible to the eye of an archer adjacent the rear surface, an "off" position in which the cover blocks the incident light from the eye and at least one intermediate position in which the cover partially blocks the incident light from the eye.

In one embodiment, the rear peep sight has a cover rotatably mounted on the rear surface. This cover has at least one opaque area, at least one partially transparent area, and a transparent area and is selectively moveable between an "on" position in which the transparent area covers the locator aperture, the at least one "intermediate on" position in which the partially transparent area covers the locator aperture, and an "off" position in which the opaque area covers the locator aperture.

In an alternate embodiment, the sighting body has a front surface and a rear surface joined by a side surface, and an arcuate locator aperture formed in the rear surface. A means is provided for transmitting ambient light incident at the front surface to the rear surface through the arcuate locator aperture. The means for transmitting ambient light is rotatably mounted in a cavity in the sighting body. A fixed cover mounted on the rear surface over one end of the arcuate locator aperture permits the means for transmitting ambient light to be selectively rotated between an "on" position away from the cover and an "off" position under the cover.

The rear peep sight also includes slots for mounting in a bowstring and a post for aligning a longitudinal axis of the sighting aperture with a longitudinal axis of an arrow when the sighting body is mounted in bowstring of a bow.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a rear elevation view of a peep sight apparatus in accordance with the present invention with the ambient illumination turned on;

FIG. 4 is a side elevation view of the peep sight shown in the FIG. 1;

FIG. 5 is a side elevation view of the insert for the peep sight apparatus shown in the FIG. 1;

FIG. 6 is a view similar to the FIG. 1 with the ambient illumination turned off;

FIG. 7 is a rear elevation view of the sighting body shown in the FIG. 1;

FIG. 8 is a rear elevation view of an alternative embodiment of a peep sight apparatus in accordance with the present invention;

FIG. 9 is an enlarged fragmentary view taken in the direction of the line 9—9 in the FIG. 8;

FIG. 10 is a side elevation view of an insert for the peep sight apparatus shown in the FIG. 8;

FIG. 15 is an enlarged view of a portion of the cover shown in the FIG. 14;

FIG. 16 is a view showing the relative thickness of sections of the cover shown in the FIG. 15;

FIG. 17 is a side elevation view showing an alternative embodiment mounting of a peep sight of the invention configured to compensate for the angle of the bowstring at full draw;

FIG. 18 is a side elevation view showing another alternative embodiment mounting for configuring a peep sight of the invention to compensate for the angle of the bowstring at full draw;

FIG. 19 is an enlarged rear elevation view of the peep sight shown in the FIG. 18.

DESCRIPTION OF THE PREFERRED EMBODIMENT

Figure 1:
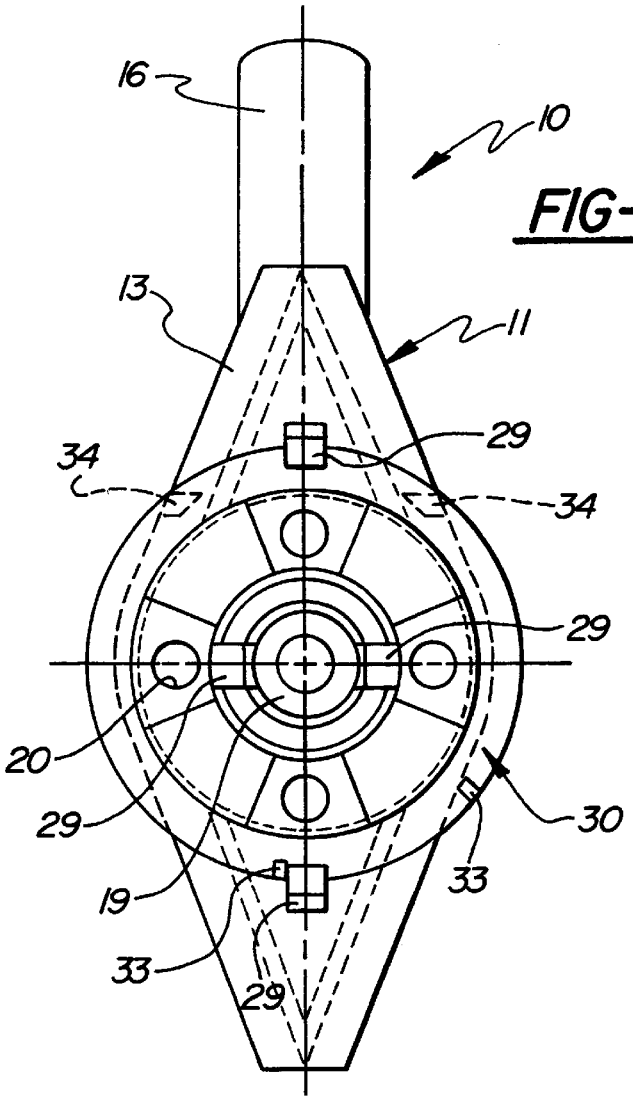
Figure 3:
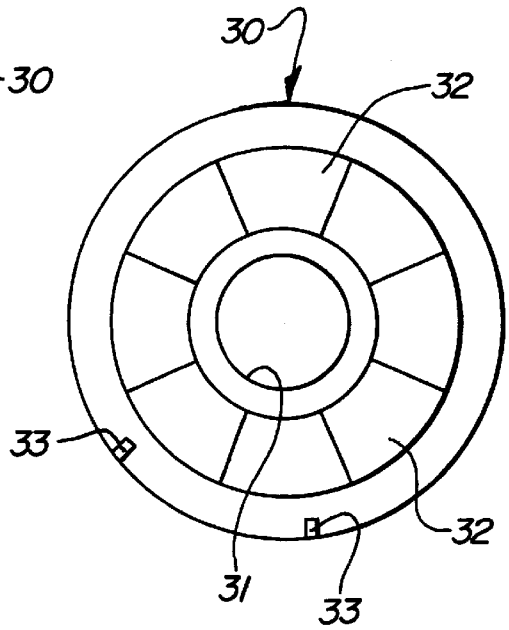
FIG. 3 is a rear elevation view of the cover shown in the FIG. 1.
Figure 2:
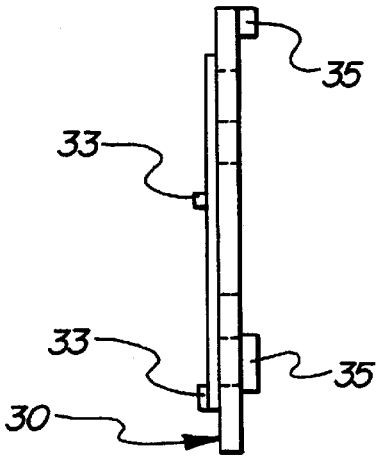
FIG. 2 is a side elevation view of the cover shown in the FIG. 1.

There is shown in the FIGS. 1–7, a peep sight 10 similar in construction to the peep sights shown in the U.S. Pat. No. 5,669,146 which patent is incorporated herein by reference. The peep sight 10 includes a generally elliptical sighting body 11 that is wider in a central portion and narrower at upper and lower end portions. The body 11 has a generally planar front surface 12 spaced from and generally parallel to a generally planar rear surface 13. The front and rear surfaces are connected by a side surface 14 extending completely around the body 11. A mounting groove in the form of a concave slot 15 is formed in the side surface 14 and extends around the body 11. The sighting body 11 is typically formed of an opaque material and a bowstring, in which the peep sight 10 is to be mounted, is typically formed of a plurality of strands which can be separated into two generally equal size groups. The groups of strands of the bowstring are inserted into the slot 15 to retain the body 11 in the bowstring. Extending outwardly and upwardly from an upper portion of the front surface 12 is a post 16 that is utilized to attach one end of a cord (not shown) to the rear peep sight 10. For example, the cord can be a hollow rubber tube having an inside diameter which is slightly smaller than the outside diameter of the post 16 such that when the post is inserted into one end of the tube, the tube and the rear peep sight are frictionally coupled together. The cord and the post 16 are utilized to align the front surface 12 perpendicular to a longitudinal axis of an arrow when the bow is drawn.

There is formed in the sighting body 11 a generally circular cavity 17 that is open at the front surface 12 and extends beyond the concave slot 15 into the body to a generally planar bottom surface 18 spaced from the rear surface 13. A sighting aperture 19 is formed in the sighting body 11 and extends from the rear surface 13 to the bottom surface 18 of the cavity 17. Thus, there is an unobstructed view for an archer from the rear surface 13 to the front surface 12 through the sighting aperture 19 and the cavity 17. The sighting aperture 19 is tapered from a larger diameter at the rear surface 13 to a smaller diameter at the juncture with the bottom surface 18 of the cavity 17. A plurality of locator apertures 20 also are formed in the sighting body 11 which apertures are smaller in diameter than and are located equidistant from the sighting aperture 19. Although four locator apertures 20 are shown, more or less could be utilized. The locator apertures 20 extend from the rear surface 13 to the bottom surface 18 of the cavity 17.

The rear peep sight 10 also includes an insert body 21 that is generally cylindrical in shape and has a generally planar front surface 22 extending generally parallel to a spaced apart generally planar rear surface 23. The front surface 22 and the rear surface 23 are connected by a side surface 24 extending about the periphery of the insert body 21. Extending outwardly from the rear surface 23 is a plurality of locator pins 25. When the insert body 21 is inserted into the cavity 17 with the rear surface 23 abutting the bottom surface 18, each of the locator pins 25 extends through a corresponding one of the locator apertures 20. Each of the locator pins 25 has a rounded outer end that extends beyond the rear surface 13.

While the insert body 21 is in the cavity 17, the rear peep sight 10 can be installed in the bowstring. The diameter of the cavity 17 is greater than the spacing between the bottom surfaces of the slot 15 at a central portion of the body 11 such that openings 26 to the cavity are formed in the side surface 14. Individual strands of the bowstring are received in the concave slot 15 and are forced into the openings 26 so as to engage a groove or slot 27 formed in the side surface 24 of the insert body 21. The strands of the bowstring thus retain the insert body 21 in the cavity 17. The insert body 21 has an insert aperture 28 formed therein generally concentric with the sighting aperture 19 when the insert body is in the cavity 17. The insert aperture 28 has a front tapered portion which tapers from a smaller diameter internal of the body 21 to a larger diameter at the front surface 22.

Typically, the insert body 21 is formed of a light transmitting transparent or translucent material such that light incident at the front surface 22 is transmitted through the insert body to the rounded ends of the locator pins 25 where such light can be observed by the archer. The rear peep sight 11 is especially useful in low light conditions when it is difficult for the archer to see whether a sighting aperture, such as the sighting aperture 19, is aligned properly with a target. Ambient light is transmitted through the insert body 21 and is concentrated in the ends of the locator pins 25 to provide visible reference points for the archer who knows that the center of the sighting aperture 19, at a longitudinal axis L, is centered with respect to the locator pins 25.

The purpose of the present invention is to allow the locator pins 25 that protrude from the rear surface 13 of the peep sight 10 to be "turned off" in high ambient light situations. In high ambient light situations, the archer's eye at full draw of his bow sees a haze, for example a green haze if the insert body 21 is tinted green, produced by the light transmitted to the ends of the pins 25. Some archers find this haze to be a distraction. The following description of an improved sight eliminates this problem by allowing the archer to "turn off" the light from the pins 25 if he or she chooses to do so.

A plurality of snap hooks or cover lock pins 29 are molded on the rear surface 13 of the peep sight body 11 that allow a partially opaque cover 30 to be snapped in place against the rear surface of the sight over the ends of the pins 25. Two of the hooks 29 are diametrically opposed and engage an outer periphery of the cover 30. Two more of the hooks 29 also are diametrically opposed and engage an edge of a central sighting aperture 31 formed in the cover 30. Preferably, the hooks 29 are spaced at equal intervals. A plurality of opaque areas 32 are provided on the cover 30 extending radially outwardly from the sighting aperture 31 and spaced apart at equal intervals.

The cover 30 is held in place by the hooks 29 in such a way as to allow the cover to be rotated from an "on" position (FIG. 1), where the pins 25 are lit by the ambient light, to an "off" position (FIG. 6) where the opaque areas 32 block the pins 25 and the transmitted light from the archer's eye. A positional lock system is employed that prevents the cover 30 from rotating from one position to the other unless changed by the archer. The cover 30 is provided with a pair of axially projecting stops 33. When the cover 30 is rotated in a counterclockwise direction until one of the stops 33 abuts the lowermost one of the hooks 29, as shown in the FIG. 1, the opaque areas 32 are positioned between the locator apertures 20 and the pins 25 are visible through transparent or translucent portions of the cover such that a predetermined maximum amount of the incident light is transmitted through the insert body 21 to the archer's eye.

When the cover 30 is rotated in a clockwise direction until the other one of the stops 33 abuts the lowermost one of the hooks 29, as shown in the FIG. 6, the opaque areas 32 are positioned over the locator apertures 20 and the pins 25 are not visible. Of course, it is possible to position an edge of the opaque area 32 over the corresponding locator aperture 20 to partially block the ambient light.

A pair of locking recesses 34 are formed in the rear surface 13 at the periphery of the sighting body 11. The side of the cover 30 facing the surface 13 is provided with a pair of locking tabs 35. In the positions of the cover 30 shown in the FIG. 1 and the FIG. 6, one of the tabs 35 engages an associated one of the recesses 34 to prevent unintentional rotation of the cover. A predetermined amount of rotational force applied to the cover 30 will overcome the frictional engagement of the tab 35 with the recess 34 to permit rotation of the cover.

An alternative embodiment of the invention is illustrated in FIGS. 8–12. There is shown in the drawings a peep sight 40 having a generally elliptical sighting body 41 that is wider in a central portion and narrower at upper and lower end portions. The body 41 has a generally planar front surface 42 spaced from and generally parallel to a generally planar rear surface 43. The front and rear surfaces are connected by a side surface 44 extending completely around the body 41. A mounting groove in the form of a concave slot 45 is formed in the side surface 44 and extends around the body 41. The sighting body 41 is typically formed of an opaque material and a bowstring (not shown), in which the peep sight 40 is to be mounted, is typically formed of a plurality of strands which can be separated into two generally equal size groups. The groups of strands of the bowstring are inserted into the slot 45 to retain the body 41 in the bowstring. Extending outwardly and upwardly from an upper portion of the front surface 42 is a post 46 that is utilized to attach one end of a cord (not shown) to the rear peep sight 40. For example, the cord can be a hollow rubber tube having an inside diameter which is slightly smaller than the outside diameter of the post 46 such that when the post is inserted into one end of the tube, the tube and the rear peep sight are frictionally coupled together. The cord and the post 46 are utilized to align the front surface 42 perpendicular to a longitudinal axis of an arrow when the bow is drawn.

There is formed in the sighting body 41 a generally circular cavity 47 that is open at the front surface 42 and extends beyond the concave slot 45 into the body to a generally planar bottom surface 48 spaced from the rear surface 43. A sighting aperture 49 is formed in the sighting body 41 and extends from the rear surface 43 to the bottom surface 48 of the cavity 47. Thus, there is an unobstructed view for an archer from the rear surface 43 to the front surface 42 through the sighting aperture 49 and the cavity 47. The sighting aperture 49 is tapered from a larger diameter at the rear surface 13 to a smaller diameter at the juncture with the bottom surface 48 of the cavity 47. A plurality of arcuate locator apertures 50 also are formed in the sighting body 41 which apertures are smaller in area than and are located equidistant from the sighting aperture 49. Although four locator apertures 50 are shown, more or less could be utilized. The locator apertures 50 extend from the rear surface 43 to the bottom surface 48 of the cavity 47.

Figure 11:
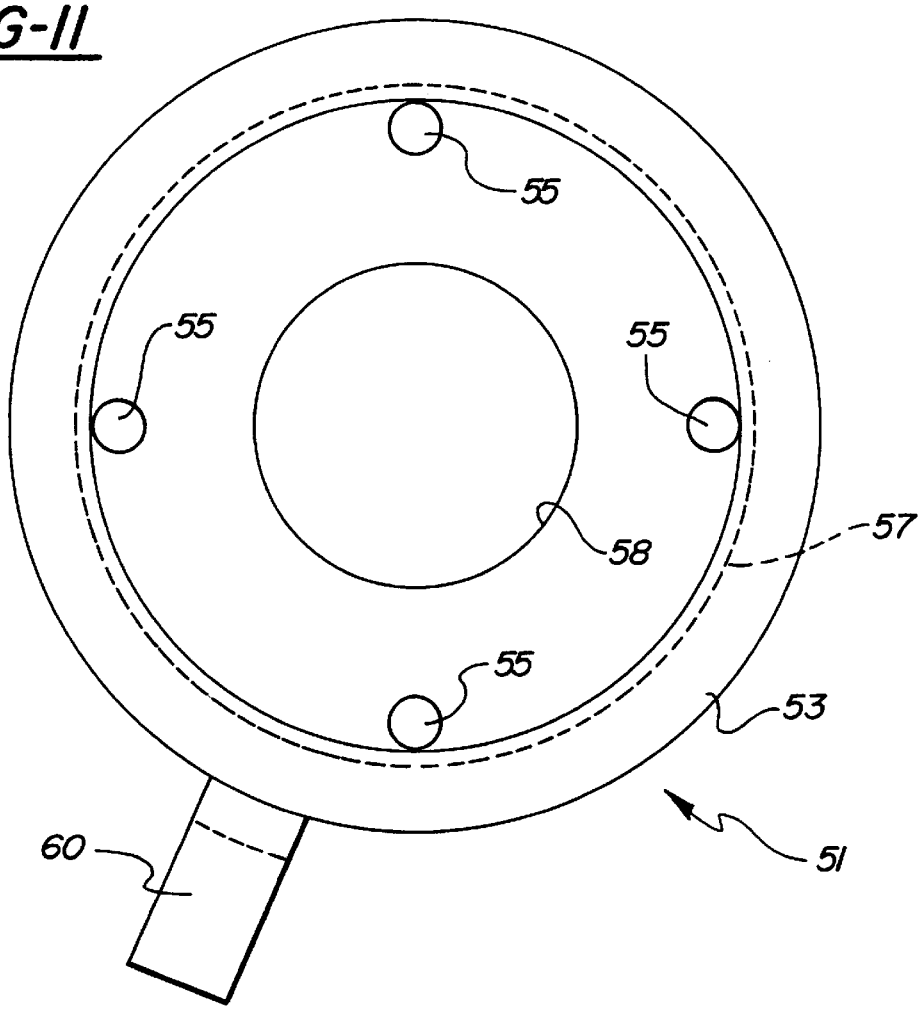
FIG. 11 is a rear elevation view of the insert shown in the FIG. 10.

The rear peep sight 40 also includes an insert body 51 that is generally cylindrical in shape and has a generally planar front surface 52 extending generally parallel to a spaced apart generally planar rear surface 53 as shown in FIGS. 10 and 11. The front surface 52 and the rear surface 53 are connected by a side surface 54 extending about the periphery of the insert body 51.

Figure 12:
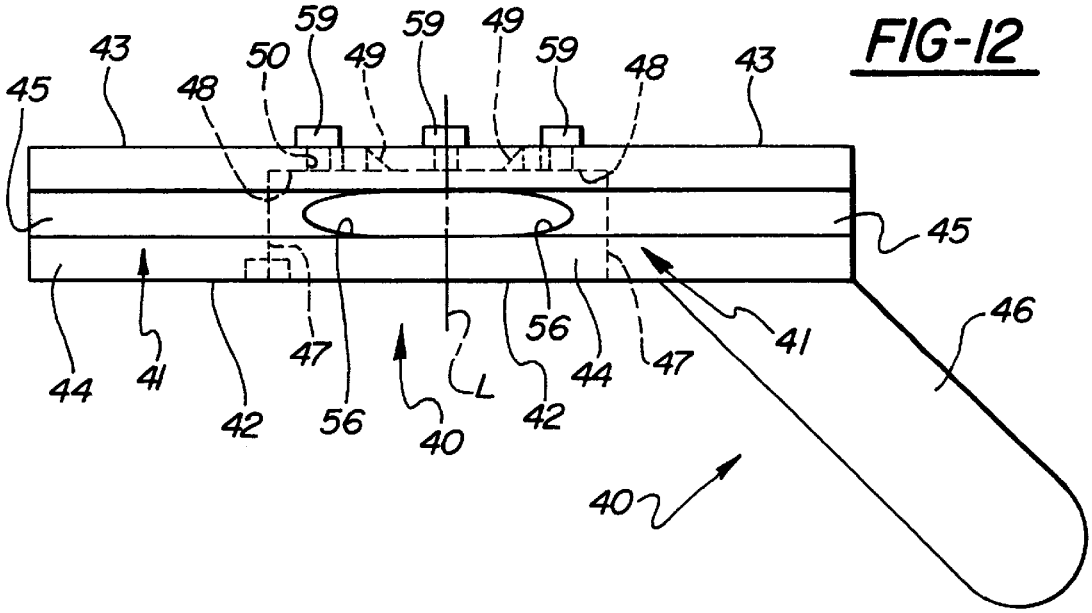
FIG. 12 is a side elevation view of the peep sight apparatus shown in the FIG. 8.
Figure 13:
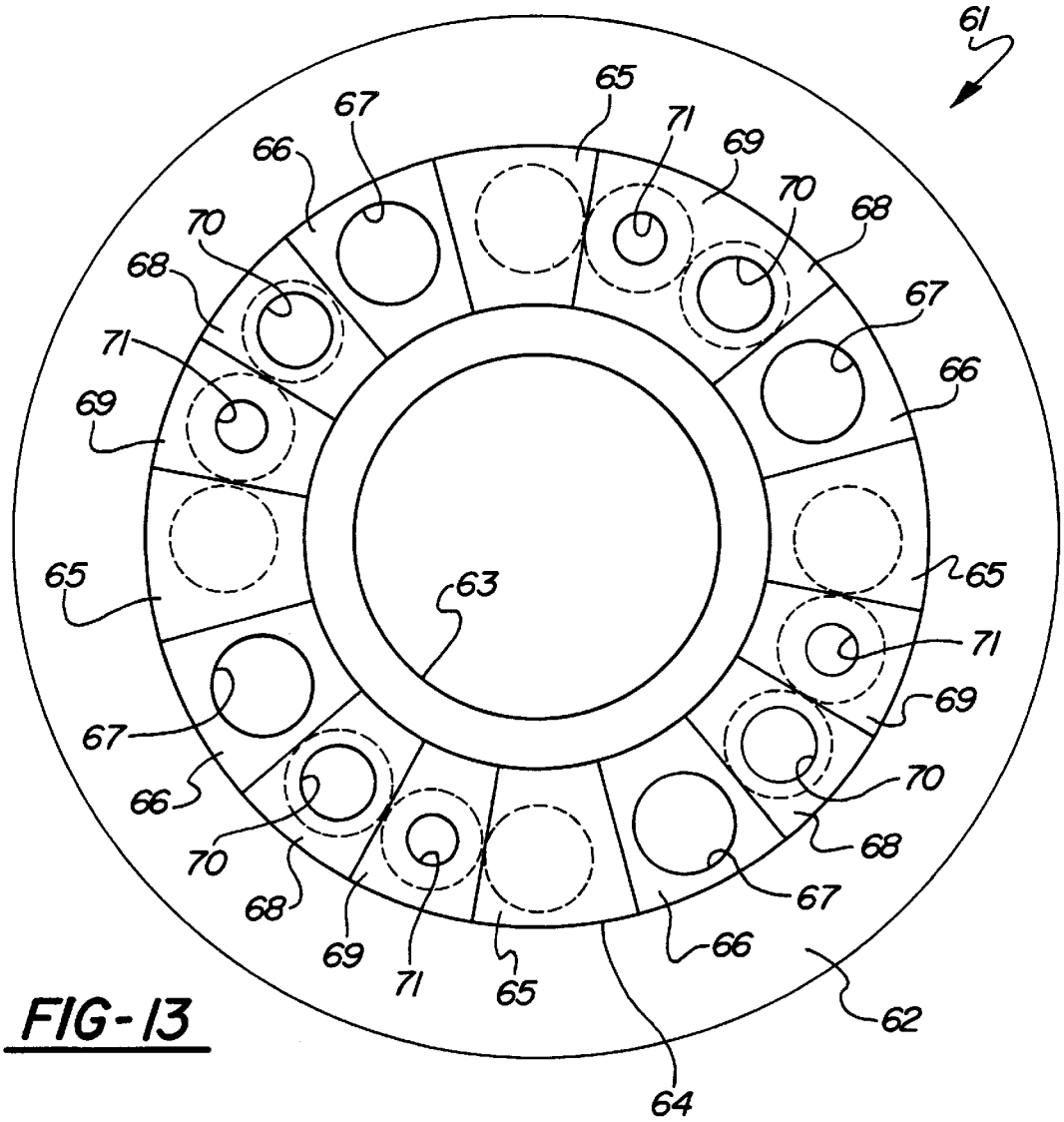
FIG. 13 is a rear elevation view of an alternative embodiment cover for the peep sight apparatus shown in the FIG. 8.
Figure 14:
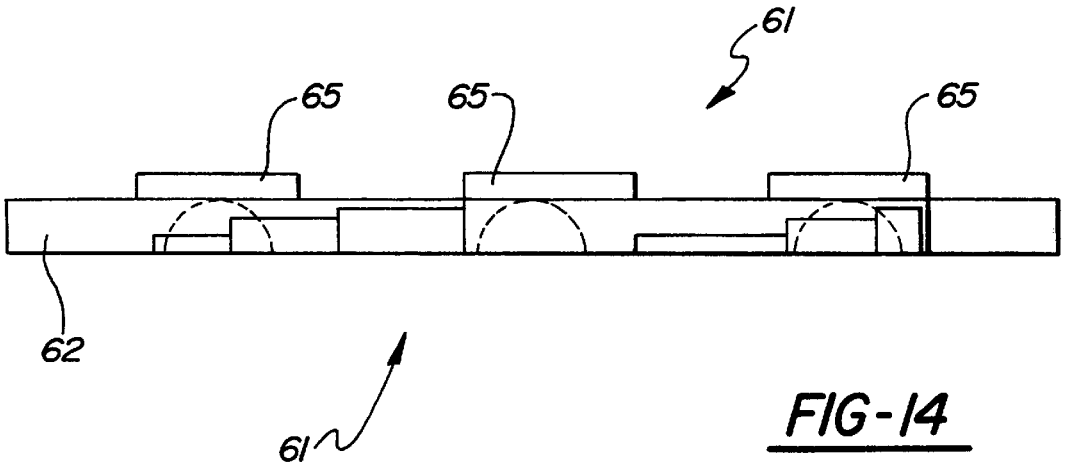
FIG. 14 is a side elevation view of the cover shown in the FIG. 13.

Extending through the body 51 are a plurality of locator pins 55. When the insert body 51 is inserted into the cavity 47 with the rear surface 53 abutting the bottom surface 48, each of the locator pins 55 extends through a corresponding one of the locator apertures 50. While the insert body 51 is in the cavity 47, the rear peep sight 40 can be installed in the bowstring. The diameter of the cavity 47 is greater than the spacing between the bottom surfaces of the slot 45 at a central portion of the body 41 such that openings 56 to the cavity are formed in the side surface 34 as shown in FIG. 12. Individual strands of the bowstring are received in the concave slot 45 and are forced into the openings 56 so as to engage a groove or slot 57 formed in the side surface 54 of the insert body 51. The strands of the bowstring thus retain the insert body 51 in the cavity 47.

The insert body 51 has an insert aperture 58 formed therein generally concentric with the sighting aperture 49 when the insert body is in the cavity 47. The insert aperture 58 has a front tapered portion which tapers from a smaller diameter internal of the body 51 to a larger diameter at the front surface 52. Typically, the insert body 51 is formed of an opaque material and the locator pins 55 are formed from a light transmitting, transparent, or translucent material such that light incident at the front surface 52 is transmitted through the insert body to the opposite ends of the locator pins 55 where such light can be observed by the archer.

The rear peep sight 41 is especially useful in low light conditions when it is difficult for the archer to see whether a sighting aperture, such as the sighting aperture 49, is aligned properly with a target. Ambient light is transmitted through the locator pins 55 and is concentrated in the ends of the locator pins at the apertures 50 to provide visible reference points for the archer who knows that the center of the sighting aperture 19, at the longitudinal axis L, is centered with respect to the locator pins 55.

The amount of ambient light gathered by the locator pins 55 will vary with the extent that the pins protrude beyond the front surface 52 of the body 51. Therefore, a pin length designed to gather the maximum light in the lowest ambient light conditions might produce a too bright display in higher ambient light conditions. The purpose of the present invention is to allow the locator pins 55 that protrude from the rear surface 43 of the peep sight 40 to be "turned off" in high ambient light situations, as discussed above.

A plurality of fixed covers 59 are molded on the rear surface 43 of the peep sight body 41 each extending over a corresponding end portion of an associated one of the apertures 50. The insert body 51 has a lever 60 formed on the front surface 52 which lever extends outwardly axially and radially to provide a means for gripping by a human thumb and forefinger. The insert 51 is rotatable in the cavity 47 limited by engagement of the locator pins 55 at the opposite ends of the arcuate apertures 50. As viewed from the rear surface 43, the pins 55 will be at maximum brightness at full counterclockwise rotation and will be completely obscured by the covers 59 at full clockwise rotation. The brightness can be regulated by rotating the pins 55 so as to be partially obscured by the covers 59.

Another embodiment of the rear peep sight according to the present invention is shown in the FIGS. 13–16. An opaque cover 61 can be fixed to the rear surface 43 of the body 41 whereby the insert 51 is rotated in the cavity. Alternatively, the cover 61 can be rotatably mounted on the rear surface 43 and rotated relative to the insert 51 that is fixed in the cavity 47. The cover 61 has a generally thin circular body 62 having a cover aperture 63 formed in the center thereof for alignment with the sighting aperture 49 and the insert aperture 58. Spaced radially outwardly from the aperture 63 is an annular mask portion 64 aligned with the locator pins 55. A plurality of equally spaced apart "off" sections 65 are provided in the mask portion 64 for completely blocking the locator pins 55 when aligned therewith.

A plurality of equally spaced apart "on" sections 66 are provided in the mask portion 64 adjacent to each of the "off" sections 65 in a counterclockwise direction. Each of the "on" sections 66 has a full "on" aperture 67 formed therein of a diameter sufficient for completely exposing the locator pins 55 when aligned therewith. A plurality of equally spaced apart first intermediate "on" sections 68 and a plurality of equally spaced apart second intermediate "on" sections 69 are provided in the mask portion 64 between the "off" sections 65 and the "on" sections 66. Each of the first intermediate "on" sections 68 has a first intermediate "on" aperture 70 formed therein of a diameter smaller than the diameter of the apertures 67 for partially exposing the locator pins 55 when aligned therewith.

Each of the second intermediate "on" sections 69 has a second intermediate "on" aperture 71 formed therein of a diameter smaller than the diameter of the apertures 70 for partially exposing the locator pins 55 when aligned therewith (thereby providing a partially transparent mask). Thus, the pins 55 can be aligned with selected ones of the sections 65, 66, 68, and 69 to vary the amount of ambient light reaching the eye of the archer from a predetermined maximum to none. As stated above, the cover 62 can be rotated relative to an insert or the insert can be rotated relative to the cover. The apertures 67, 70 and 71 can be formed as openings in the cover 61, or can be transparent or translucent areas in an otherwise opaque surface. In still another aspect of the invention, the portion of the cover 61 corresponding to the apertures 67, 70 and 71 and the "off" section 65 can be a uniform gradient from opaque to transparent thereby providing the archer with infinite possible gradations in illumination.

Another aspect of the present invention is a means for positioning the sighting body of a rear peep sight of the type described herein to compensate for the angle of the bowstring at full draw so that the archer has sight line that is parallel with the longitudinal axis L of the sighting aperture. In the embodiments of the invention described above, the a longitudinal axis L is generally perpendicular to the axes of the slots 15 and 45 that engage and retain the strands of the bowstring. Thus, as the bow is draw the peep sight will assume the angle of the bowstring thereby tilting the sighting aperture relative to the horizontal and shortening the top to bottom distance. For example, a compound bow having a 47" axle-to-axle distance with a 30" arrow at full draw results in a bowstring angle of approximately 41°. The peep sights 10 and 40 are configured to provide an adequate view through the sighting aperture up to approximately a 45° bowstring angle. However, as compound bows are made shorter, the bowstring angle can exceed 45° and must be compensated for.

This compensation can be accomplished, as illustrated in FIG. 17, by mounting a peep sight 80 at an angle relative to the bowstring retaining slots. The peep sight 80 has a sighting body 81 with a front surface 82 and a rear surface 83 joined by a side surface 84. Extending outwardly from the side surface 84 is a pair of opposed bowstring retainers 84*a* (only one is shown) each having a bowstring retaining slot 85 formed therein. The retainers 84*a* and the slots 85 are angled relative to the longitudinal axis L of the sighting aperture at a predetermined angle (such as 41°, 45°, or any other angle) so that the longitudinal axis L will be substantially horizontal when the bow is at full draw. An attachment post 86 for an alignment string may optionally be included as part of the sighting body 80.

Alternatively, as illustrated in FIGS. 18 and 19, the bowstring angle may be compensated for by forming a peep sight 90 that can be served into a bowstring B. The peep sight 90 has a sighting body 91 with a front surface 92 and a rear surface 93 joined by a side surface 94. An insert body 101 has a plurality of locator pins 105 and is similar to the insert body 21 described above. Extending forwardly from the insert body 101 is a mounting block 101*a* having an opposed pair of slots 95 (only one is shown) each for retaining a portion of the strands of the bowstring B which has been separated into two equal portions. The bowstring B is held together by serving S above the mounting block 101*a*. Extending downwardly from the rear surface 93 is a post 96 that is attached to the bowstring B by serving S. Thus, the peep sight 90 is held securely in position in the bowstring B. As described above, the slots 95 are angled relative to the longitudinal axis L of the sighting aperture at a predetermined angle (such as 41°, 45°, or any other angle) so that the longitudinal axis L will be substantially horizontal when the bow is at full draw.

The peep sight 90 shown in the FIGS. 18 and 19 retains the advantages of the other embodiments of the present invention discussed above over the prior art peep sights and has additional advantages. Referring first to the FIG. 17, the point at which the longitudinal axis L of the sighting aperture intersects the longitudinal axis of bowstring retaining slot 85 lies at approximately the center of the sighting body 81. Thus, the eye of the archer (not shown) will be a predetermined distance behind the rear surface 83 and the rear surface will block a first predetermined area of light from the archer's view while the sighting aperture will provide a second smaller predetermined viewing area for seeing the target. As is apparent from the FIG. 18, for the same eye to bowstring distance along the longitudinal axis L, the rear surface 93 will be closer to the eye of the archer E. Therefore, if the rear surface 93 is the same size as the rear surface 83, it will block a larger area of light from the archer's eye E. This configuration permits the area of the rear surface 93 to be reduced to block the same "first predetermined area of light" resulting in a lighter weight peep sight 90.

Another advantage of the peep sight 90 is that if sighting aperture is the same size as the sighting aperture in the peep sight 80, the field of vision of the archer's eye E is increased. Conversely, the size of the field of vision can be maintained by reducing the size of the sighting aperture.

Figure 20:
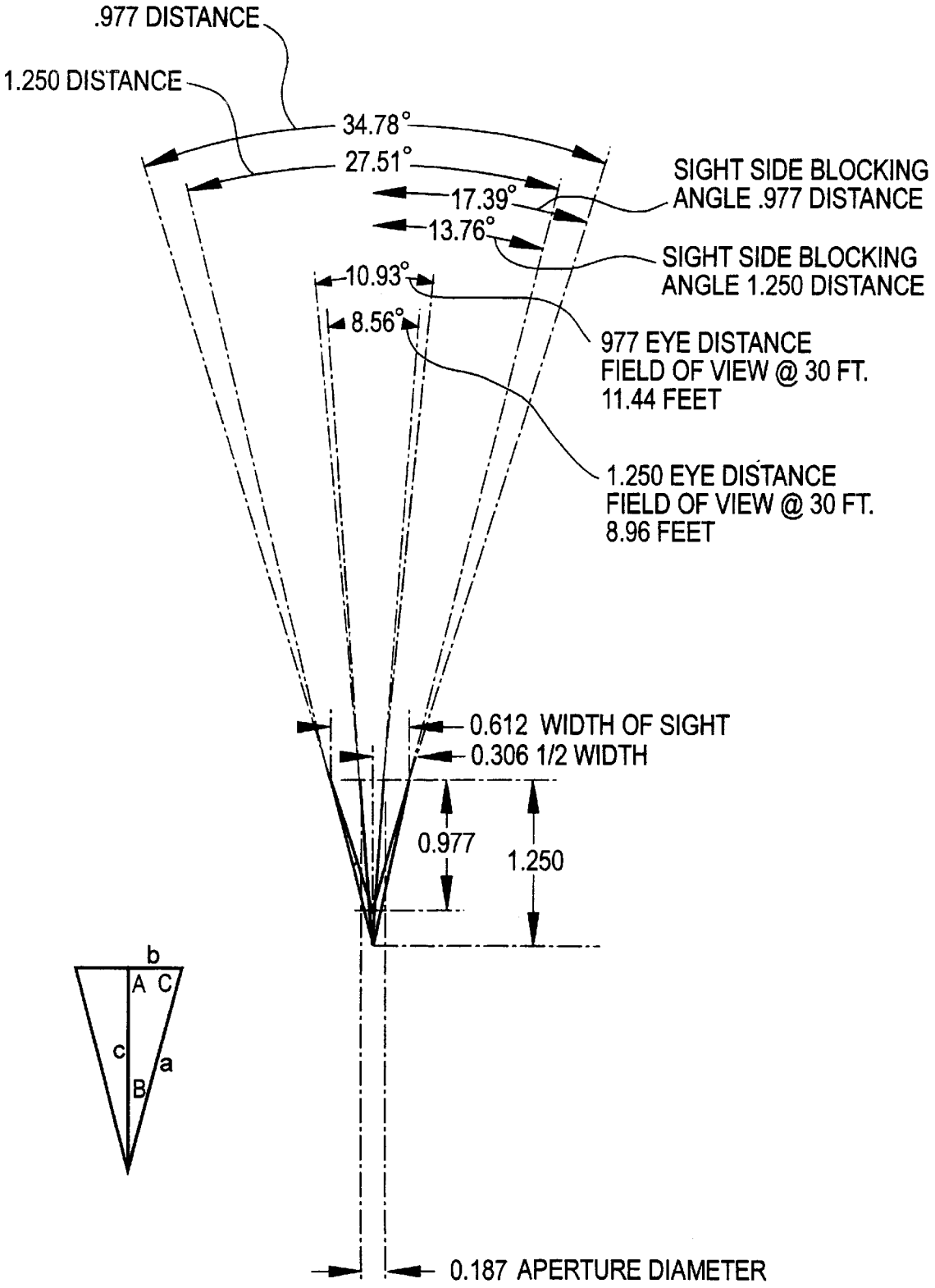
FIG. 20 is a schematic diagram showing a comparison of the blocking angle and field of vision for two different eye to peep sight distances.

An example of both of these advantages is shown in the FIG. 20. A model of the peep sight 80 shown in the FIG. 18 was constructed and installed in a bowstring. The model peep sight 80 had a 0.187 inch diameter sighting aperture and a 0.612 inch width of the rear surface 83. The peep sight 80 was tested at a distance of 1.250 inches from the position of the eye of an archer that is the normal position for sighting at full draw of the bowstring. The measured angle of blocking in a generally horizontal plane at the longitudinal axis L was 27.51°. The field of view at the same measuring point was a viewing angle of 8.56° (8.96 feet wide) at a target distance of thirty feet.

A model of the peep sight 90 was tested under the same conditions. The mounting configuration of the peep sight 90 placed the rear surface 93 0.977 inches from the same position of the eye of the archer relative to the bowstring. The blocking angle increased to 34.78° and the field of vision at thirty feet increased to a viewing angle of 17.39° (11.44 feet wide). These increases are significant when compared to the blocking and viewing angles of the prior art peep sights having the same size bodies and viewing apertures.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A rear peep sight to be mounted in a bowstring for aiming an arrow, comprising:

a sighting body having front and rear surfaces joined by a side surface, a cavity formed in said sighting body open to said front surface, a sighting aperture formed in said sighting body having a longitudinal axis extending from said rear surface to said cavity and providing a view through said sighting body, and at least one locator aperture formed in said rear surface adjacent said sighting aperture and extending from said rear surface to said cavity;

means for transmitting ambient light incident at said front surface to said rear surface through said locator aperture, said means for transmitting being removably retained in said cavity; and at least one cover mounted on said rear surface, said at least one cover and said means for transmitting being selectively moveable relative to one another to an "on" position in which a predetermined maximum amount of the incident light is visible to an eye of an archer adjacent said rear surface, an "off" position in which said at least one cover blocks the incident light from the eye and at least one intermediate position in which said at least one cover partially blocks the incident light from the eye.

2. The rear peep sight of claim 1 wherein said means for transmitting ambient light includes a light transmitting pin extending through said at least one locator aperture and beyond said rear surface.

3. The rear peep sight of claim 1 wherein said at least one cover has a light transmitting "on" section and an adjacent opaque "off" section corresponding respectively with said "on" and "off" positions.

4. The rear peep sight of claim 1 including at least a pair of snap hooks attached to said rear surface for rotatably retaining said cover and permitting said cover to be rotated relative to said means for transmitting ambient light.

5. The rear peep sight of claim 4 including at least a pair of stops attached to said at least one cover for engaging one of said snap hooks, one of said stops engaging said one snap hook in said "on" position and another of said stops engaging said one snap hook in said "off" position.

6. The rear peep sight of claim 1 wherein said at least one cover is rotatably mounted on said rear surface and including at least one recess formed in said sighting body and an associated tab attached to said at least one cover, said tab releasably engaging said at least one recess in one of said "on" and "off" positions to prevent unintentional rotation of said at least one cover.

7. The rear peep sight of claim 1 wherein said at least one locator aperture has an arcuate shape, said at least one cover is attached to said rear surface covering one end portion of said at least one locator aperture and said means for transmitting ambient light is rotatable in said cavity for movement from said one end portion of said at least one locator aperture to an opposite end of said at least one locator aperture.

8. The rear peep sight of claim 7 wherein said means for transmitting ambient light has a radially extending lever attached thereto for manual rotation of said means for transmitting ambient light relative to said at least one cover.

9. The rear peep sight of claim 1 wherein said at least one cover has at least two light transmitting "on" sections and an adjacent opaque "off" section, one of said "on" sections having a full "on" aperture corresponding to said "on" position and another one of said "on" sections having an intermediate "on" aperture for transmitting less of the ambient light than said full "on" aperture.

10. The rear peep sight of claim 1 including a post extending from said front surface for aligning said longitudinal axis of said sighting aperture with a longitudinal axis of an arrow when the sighting body is mounted in a bowstring of a bow.

11. The rear peep sight of claim 1 including a post extending from said rear surface for aligning said longitudinal axis of said sighting aperture with a longitudinal axis of an arrow when the sighting body is mounted in a bowstring of a bow.

12. The rear peep sight of claim 1 including a pair of string retainers each extending outwardly from opposite sides of said sighting body, each said string retainer including a bowstring retaining groove extending at a predetermined angle relative to said longitudinal axis of said sighting aperture.

13. The rear peep sight of claim 12 wherein said predetermined angle is approximately 45°.

14. The rear peep sight of claim 1 including a mounting block attached to said means for transmitting ambient light and extending beyond said front surface of said sighting body for engaging a bowstring of a bow.

15. A rear peep sight to be mounted in a bowstring for aiming an arrow, comprising:

a sighting body having front and rear surfaces joined by a side surface, a cavity formed in said sighting body open to said front surface, a sighting aperture formed in said sighting body having a longitudinal axis extending from said rear surface to said cavity and providing a view through said sighting body, and a plurality of locator apertures formed in said rear surface adjacent said sighting aperture and extending from said rear surface to said cavity;

means for transmitting ambient light incident at said front surface to said rear surface through said locator apertures, said means for transmitting being removably retained in said cavity; and a cover rotatably mounted on said rear surface and being selectively moveable relative to said means for transmitting ambient light among an "on" position in which a predetermined maximum amount of the incident light is visible to an eye of an archer adjacent said rear surface, an "off" position in which said cover blocks the incident light from the eye and at least one intermediate position in which said cover partially blocks the incident light from the eye.

16. The rear peep sight of claim 15 wherein said means for transmitting ambient light includes a plurality of light transmitting pins each extending through a corresponding one of said locator apertures.

17. The rear peep sight of claim 15 wherein said cover has a plurality of light transmitting "on" sections and a plurality of adjacent opaque "off" sections corresponding respectively with said "on" and "off" positions.

18. The rear peep sight of claim 17 wherein said means for transmitting ambient light includes a plurality of light transmitting pins each extending through a corresponding one of said locator apertures.

19. The rear peep sight of claim 15 wherein said cover has at least two light transmitting "on" sections and an adjacent opaque "off" section corresponding to each of said locator apertures, one of said "on" sections having a full "on" aperture corresponding to said "on" position and another one of said "on" sections having an intermediate "on" aperture for transmitting less of the ambient light than said full "on" aperture.

20. A rear peep sight to be mounted in a bowstring for aiming an arrow, comprising:

a sighting body having front and rear surfaces joined by a side surface, a cavity formed in said sighting body open to said front surface, a sighting aperture formed in said sighting body having a longitudinal axis extending from said rear surface to said cavity and providing a view through said sighting body, and a plurality of arcuate locator apertures formed in said rear surface adjacent said sighting aperture and extending from said rear surface to said cavity;

means for transmitting ambient light incident at said front surface to said rear surface through said locator apertures, said means for transmitting being removably and rotatably retained in said cavity; and a plurality of covers fixedly mounted on said rear surface and each covering one end portion of a corresponding one of said locator apertures, said means for transmitting ambient light being rotatable in said cavity for movement from said one end portion of said locator apertures to an opposite end of said locator apertures.

* * * * *